US005788085A

United States Patent [19]

Pidcock

[11] Patent Number: 5,788,085

[45] Date of Patent: Aug. 4, 1998

[54] APPARATUS FOR THE RETRIEVAL AND REFILING OF DOCUMENTS IN FLAT FILE STORAGE DRAWERS

[76] Inventor: Ralph M. Pidcock, 1011 Buckingham Dr., Allentown, Pa. 18103

[21] Appl. No.: 684,820

[22] Filed: Jul. 23, 1996

[51] Int. Cl.[6] ..... B07C 7/04

[52] U.S. Cl. ..... 209/703; 209/702; 312/185; 402/80 R; 462/72; 462/76

[58] Field of Search ..... 209/702, 703, 209/509; 462/72, 76; 312/185; 402/80 R

[56] References Cited

U.S. PATENT DOCUMENTS

| | | | |
|---|---|---|---|
| 1,060,074 | 4/1913 | Fox | 402/80 R |
| 1,381,361 | 6/1921 | Studer | 312/185 |
| 2,091,809 | 8/1937 | Lisle | 312/240 |
| 2,821,452 | 1/1958 | May | 312/183 |
| 5,341,940 | 8/1994 | Pidcock | 209/703 |

FOREIGN PATENT DOCUMENTS

| | | | |
|---|---|---|---|
| 2847697 | 5/1980 | Germany | 402/80 R |

*Primary Examiner*—William E. Terrell
*Assistant Examiner*—Joe Dillon
*Attorney, Agent, or Firm*—Sanford J. Piltch

[57] ABSTRACT

A portable apparatus for retrieving and then later refiling one or more sheets of single or multi-part architectural plans, blueprints, and/or any document from a flat storage file drawer comprising a sheet separator, a first clamping element, and a second clamping element, said sheet separator having a tapered front portion and means for being mounted on at least one transverse member for slidingly coupling to runners of the storage drawer. The portable arrangement allows the removal of a single sheet from a tightly packed stack of sheets without losing the place of the single sheet in the file and to replace the single sheet in the stack of sheets without disturbing the order in which the sheets are arranged.

7 Claims, 4 Drawing Sheets

APPARATUS FOR THE RETRIEVAL AND REFILING OF DOCUMENTS IN FLAT FILE STORAGE DRAWERS

BACKGROUND OF THE INVENTION

This invention relates to an improved arrangement for retrieving documents from a storage drawer, and more particularly, to a portable arrangement that allows for the retrieval and the later refiling of a single sheet of flat stacked, sequentially arranged, architectural and engineering plans and/or blueprints, tracings, sketches, manuscripts, sepia drawings, Mylar drawing reproductions, and the like from a flat storage file drawer without losing the sequential arrangement of the stacked sheets and without mutilating the sheets.

Flat storage drawers for holding relatively large sheets, such as multi-part architectural and engineering plans and/or blueprints are well known. For example, government agencies, manufacturers, artists and cartographers all utilize flat storage drawers which hold relatively large sheets. The relatively large sheets are laid flat and form one sequentially arranged stack, and when a sufficient number of these sheets is present, it becomes difficult to retrieve a single sheet from the sequential stack without destroying the order in which the sheets are arranged, losing the place from where the sheet is retrieved, or mutilating the sheets. This difficulty is increased when the flat storage drawers are arranged in groups or tiers elevated a sufficient height from the floor so that a ladder is required in order to allow the user to gain access to the desired drawer and to then retrieve a single sheet from the flat sequential stack.

An arrangement to assist the user in retrieving documents from a flat storage drawer is disclosed in U.S. Pat. No. 2,091,809 [De Lisle] issued Aug. 31, 1937. The De Lisle patent discloses a dust cover and rack apparatus that is raised upward through an arc and remains supported in an "up" position by bracket arms attached to either side of the drawer. The sheets located above the sheet desired to be retrieved are folded over and held in position on the rack apparatus by their aggregate weight, thereby allowing the desired sheet to be retrieved and later refiled. Even though the upper sheets are partially supported by the rack assembly, a portion of such upper sheets lie on the sheet desired to be retrieved and, hence, the weight of such upper sheets hinders the retrieval and refiling of the desired sheets. Such an encumbrance often may lead to tearing, creasing or misaligning of the sheets remaining in the storage drawer. Further, the rack assembly remains with the associated drawer and is of no use to a user trying to retrieve one or more sheets from another drawer.

Another arrangement to assist in the retrieval of documents from a flat storage drawer is disclosed in U.S. Pat. No. 5,341,940 [Pidcock] issued Aug. 30, 1994. The Pidcock patent discloses a portable apparatus which features an upright rack that is placed inside the drawer so as to straddle and sit above the documents. In addition, a sheet separator is also disclosed which is attached to a transverse spanning member. The transverse spanning member is slidingly coupled to the runners of the filing drawer by a slide member allowing the sheet separator to move along the runners the distance of the depth of the filing drawer.

Using the apparatus of the Pidcock patent, a single sheet may be extracted by first folding over and clamping together the sheets located above the sheet desired to be removed and hanging the clamped sheets from the upright rack which straddles the documents. The sheets lying below the sheet selected to be extracted are clamped together at the front of the drawer. The sheet separator is then moved forward along the drawer sides lifting the sheets above the sheet selected to be extracted allowing the selected sheet to be removed.

Although the Pidcock patent discloses an efficient removal system, its operation tends to exhibit complications during operation. Placement of the upright rack and the sheet separator, and the hanging of the hook clamps, increases the time required to remove a sheet. Often the upright rack has to rest on oversized plans filed in the drawer which creates difficulty while withdrawing oversized plans. The front clamps of the Pidcock patent are disclosed as being attached or secured to the front of the filing drawer, which further complicates the operation. The sheet separator has been found to not provide proper lifting of the upper sheets because it has a single piece construction, is located in the center of the transverse spanning member, and has a tapered front end. In addition, the slide members of the Pidcock patent have a squared-off cross-section preventing them from fitting on drawers of filing cabinets which have runners with curved profiles.

It is desired that a portable arrangement be provided to allow a user to retrieve one or more sheets from any flat storage drawer having various runner profiles while freeing the one or more sheets to be removed from any encumbrance caused by the weight of the remaining upper sheets.

Accordingly, it is an object of the present invention to provide a portable arrangement to allow a single user to remove a relatively large size sheet, e.g. an architectural, engineering plan, blueprint and the like, from a flat sequential arrangement and not have the retrieved sheet encumbered by the weight of any of the remaining sheets.

It is a further object of the present invention to provide a portable arrangement having clamping means which are used to designate or preserve the sequence of the remaining sheets so that the retrieved sheet may be easily refiled back into its proper place without mutilating either the refiled sheet or any of the sheets remaining in the stack.

It is a further object of the present invention to provide a portable arrangement having clamping means which is weighted so as to retain the sheets above the sheet to be removed in the prior sequenced arrangement and requires no hanging apparatus to assist in so retaining the sheets above the sheet to be removed.

It is a further object of the present invention to provide a portable arrangement having a sheet separator for efficiently lifting the sheets above the sheet to be removed.

Still further, it is an object of the present invention to provide a portable arrangement having a slide member which is capable of sliding over differently shaped runners of filing drawers.

Further still, it is an object of the present invention to provide a portable arrangement having a slide member which assists the page separator in lifting the sheets above the sheet to be removed.

Other objects will appear hereinafter.

SUMMARY OF THE INVENTION

The present invention features a portable arrangement used in a drawer having a predetermined width and runners. The portable arrangement features a sheet separator, a first clamping means and a second clamping means. The sheet separator features two separating members which are mounted on at least one expandable transverse spanning member. The expandable transverse spanning member is mounted to two angled, tubular slide members which rest on the runners or the sides of the drawers. The separating members are slidably moved forward along the runners or sides a distance less than or equal to the depth of the drawer lifting the sheets above the sheet to be extracted. This lifting action prevents any mutilation of the sheet to be extracted.

The first clamping means includes at least one member having a surface for clampingly engaging at least one sheet below the sheet desired to be extracted. In particular, the first clamping means comprises a lever attached to a flat base portion which is yieldingly biased by a spring. The second clamping means includes at least one member having a surface for clampingly engaging at least one sheet located above the sheet to be extracted. In particular, the second clamping means comprises an adjustable vise means, which is adjusted according to the thickness of the sheets being clamped, and is mounted on a clamp arm. The clamp arm is pivotally attached to a lever arm and frame assembly which are all mounted on an elongated base member.

Other objects, advantages and novel features of the present invention will become apparent from the following detailed description of the invention when considered in conjunction with the accompanying drawings.

BRIEF DESCRIPTION OF THE DRAWINGS

For the purpose of illustrating the invention, there are shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
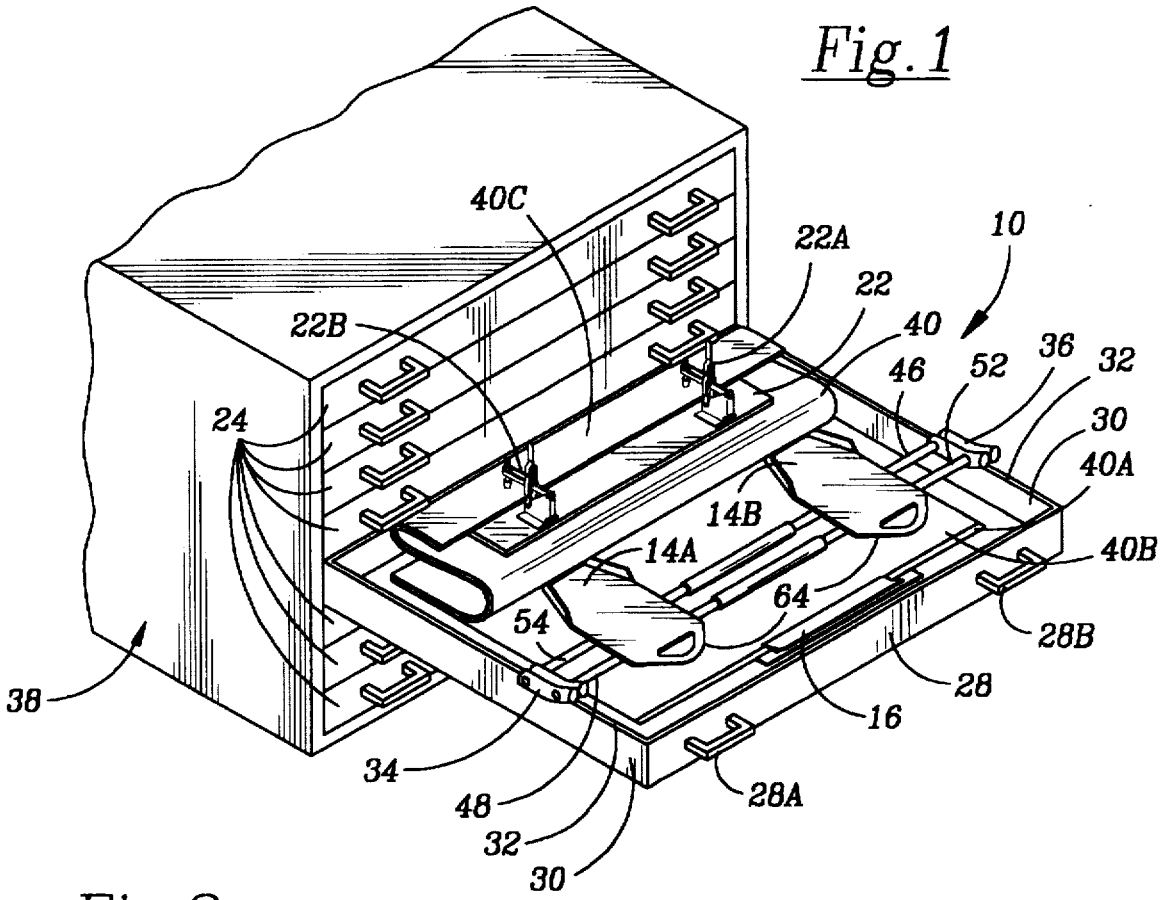
FIG. 1 is a perspective illustration showing the arrangement of the present invention for extracting at least one sheet from a plurality of sheets stacked in a flat storage drawer.

Referring now to the drawings in detail, where like numerals refer to like parts or elements, there is shown in FIG. 1, a portable arrangement 10 of the present invention. The portable arrangement 10 allows for a single sheet of relatively large size to be removed from a flat, sequentially arranged, and usually tightly packed, stack without losing the place of the retrieved sheet in the stack for later refiling therein and without disturbing or destroying the sequence of the remaining papers therein. The portable arrangement 10 comprises a sheet separator 14, first clamping means 16, and a second clamping means 22 comprising members 22A and 22B. The portable arrangement 10 is shown in FIG. 1 in position within a flat storage drawer 24.

FIG. 1 shows a plurality of drawers 24 which may be of the type described in U.S. Pat. No. 2,821,452 (May), which is incorporated herein by reference. Drawer 24 is preferably formed of sheet steel, but may be constructed of wood or plastic, and includes a front wall 28 having handles 28A and 28B attached thereto, a rear wall (not shown) and sidewalls 30. The sidewalls 30 have attached runners 32 onto which slide members 34 and 36 associated with the sheet separator 14 are detachably and slidably mounted. The runners 32 are slidably and guidably mounted onto rollers (not shown) so that the drawer 24 may be easily opened and closed. The drawer 24 may have different widths such as 30, 36, 42 or 48 inches, so as to accommodate correspondingly different sized stacked sheets of multi-part architectural and engineering plans or blueprints, or some other relatively large sized document 40 such as documents kept by government agencies, manufacturers, artists and cartographers. The stacked sheets 40 are shown in FIG. 1 for illustrative purposes as comprising a lower plurality 40A, a single sheet 40B and an upper plurality 40C.

The drawers 24 are shown in FIG. 1 as being part of a cabinet 38 which may be stacked on one another to form tiers. These tiers may be arranged in an upright vertical manner from the supporting floor at such a height so that a ladder is required to allow a person seeking to gain access to position himself or herself at the selected drawer so that at least one sheet 40B may be extracted from the stack 40. The portable arrangement 10 of the present invention eases the user's task in extracting such a sheet and may be further described with reference to FIGS. 2 and 3.

The sheet separator 14 of the portable arrangement 10 is comprised of two separating members 14A and 14B which are mounted on at least one, but preferably two, expandable transverse spanning members. The first expandable transverse spanning member is composed of transverse rod members 46 and 54 and tubular member 56. The second expandable transverse spanning member is composed of transverse rod members 52 and 48 and tubular member 50. Each of the first and second spanning members are respectively attached to the slidable members 34 and 36. In particular, the ends of rod members 46, 54, 52 and 48 are threaded and fit into apertures 76A and 76B located in slidable members 34, 36. Once inserted, a nut fits over the threaded ends of rod members 46, 54, 52 and 48 securing them in place. See FIG. 6.

Figure 6:
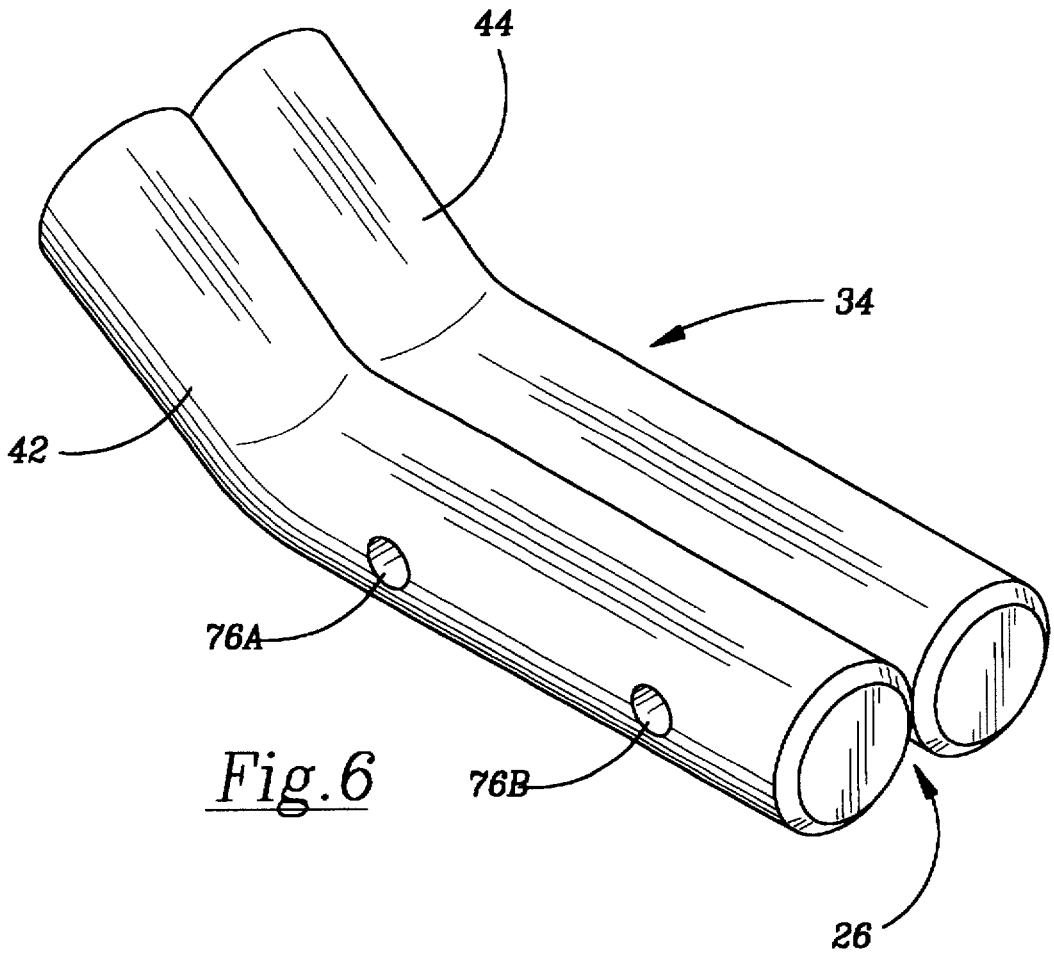
FIG. 6 is an enlarged perspective view of one of the slide members showing the angled, tubular slide member.

Slidable members 34, 36 are formed of angled tubular members capped at both ends. As shown in FIG. 6, slide member 34 is comprised of angled tubular members 42 and 44 joined together along a common tangential line between the two members to form a channel 26. Channel 26 allows slide member 34 to slide along and over drawer runners 32 of various shapes and widths. For example, in some filing drawers the runners 32 are square shaped, while in other drawers the shape of the runners 32 are rounded. A square slide member such as the one described in U.S. Pat. No. 5,341,940, which description is incorporated in its entirety herein by reference, is unable to adequately accommodate a rounded runner 32.

The rod members 46, 54 and 48, 52 are allowed to move within the tubular members 50, 56 which form an expansion means for the expandable transverse spanning members. The expansion means allows the sheet separator to have its span adjusted to drawers of different widths and more importantly, to accommodate different width sizes of the document stacks 40. The dimensions of any of these members that may support the weight of resting sheets, to be described, are selected so as to withstand such weight without encountering any substantial distortion by bending.

Two separating members 14A and 14B are equidistantly spaced along members 46, 54 and 48, 52 to be positioned to lift the sheets without buckling. Separating members 14A and 14B are relatively flat and have an elevated front portion 60 and a gripping member 64 allowing the user a hand hold on the transverse spanning member. The separator 14 (which includes the separator members 14A, 14B) is slidably coupled to the runners 32 of drawer 24 by the slide members 34 and 36. The separator 14 is slid into and under the sheets 40C, looped in a manner which will be further described below. As the separator 14 is slid into and under the sheets 40C, the sheets are lifted by the elevated front portion of the separating members 14A and 14B. In addition, the angled portion of the slide members 34 and 36 are located toward the front of the drawer 24, allowing the slide members 34 and 36 to rock forward with the sheets 40C remaining in contact with runners 32, thus providing more leverage during the lifting of sheets 40C.

Figure 2:
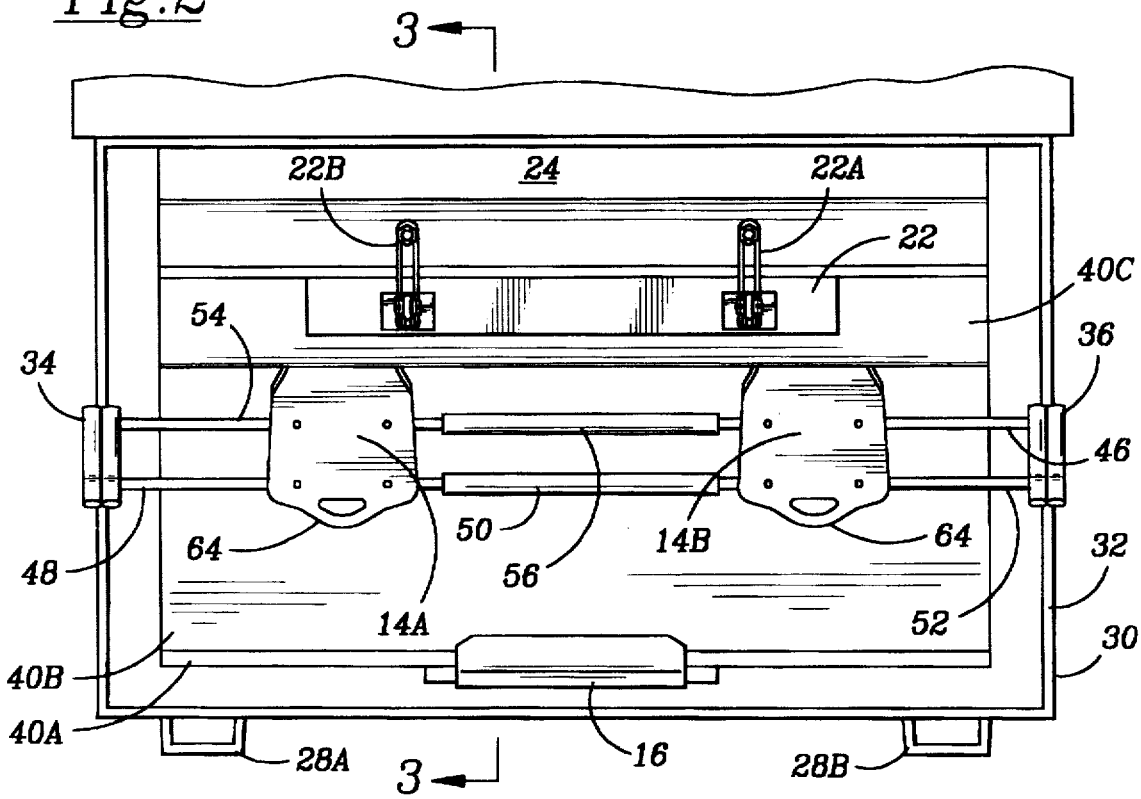
FIG. 2 is a top plan view showing further details of the arrangement of the invention shown in FIG. 1.
Figure 3:
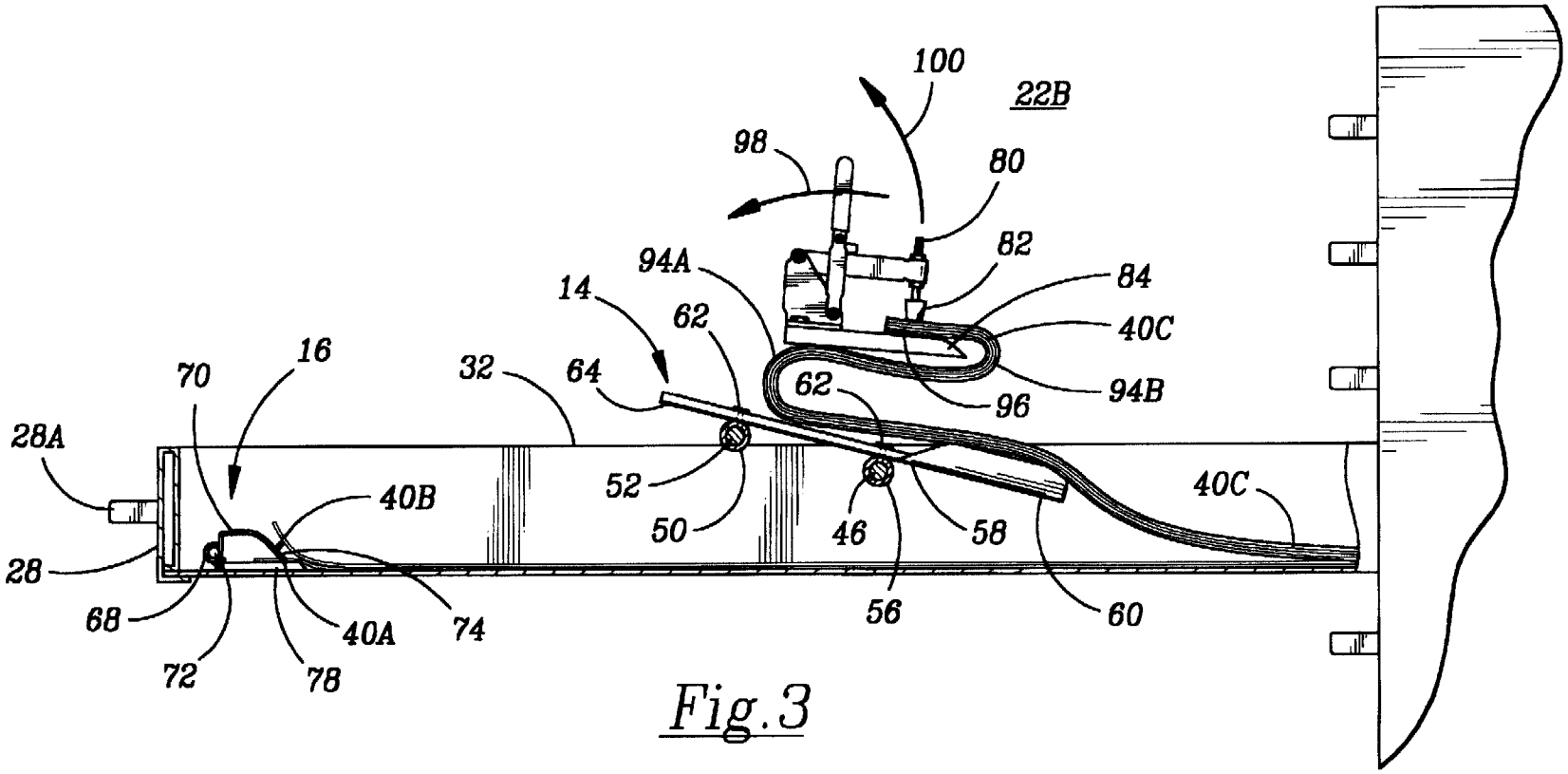
FIG. 3 is a side view of the invention, taken along line 3—3 of FIG. 2, showing further details of the arrangement of FIG. 1.
Figure 4:
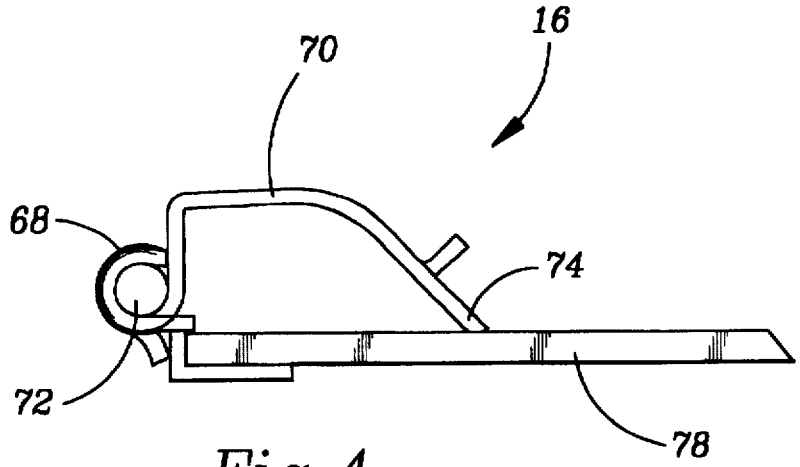
FIG. 4 is a side view of one clamping means of the invention showing further details of the first clamping means.

As shown in FIGS. 1–3, during the extraction of sheet 40B, the sheets 40A below sheet 40B are engaged by a first clamping means 16 which will be further described with reference to FIG. 4. First clamping member 16 comprises a flat base 78 and a lever member 70 connected to base 78 by a coil spring member 68 and a support member 72. The spring member 68 yieldingly responds to front lifting extension 74 of lever member 70 being pulled in an upward direction. Lever member 70 has an inner surface which provides for frictional engagement of the lower plurality of sheets 40A. During operation, the first clamping means 16 engages the lower sheets 40A while resting flat on the bottom, and at the front, of filing drawer 24. To disengage the first clamping means 16 one needs only to pull the front lifting extension 74 upwards.

Second clamping means 22 engages the sheets 40C above the sheet or sheets 40B to be extracted and will further be described with reference to FIGS. 3 and 5. The second clamping means 22 comprises a base 84 and at least one, but preferably two members 22A and 22B, for engaging sheets 40C. Members 22A and 22B are attached to the rear of base 84 so that sheets 40C are gripped between base 84 and members 22A and 22B.

Figure 5:
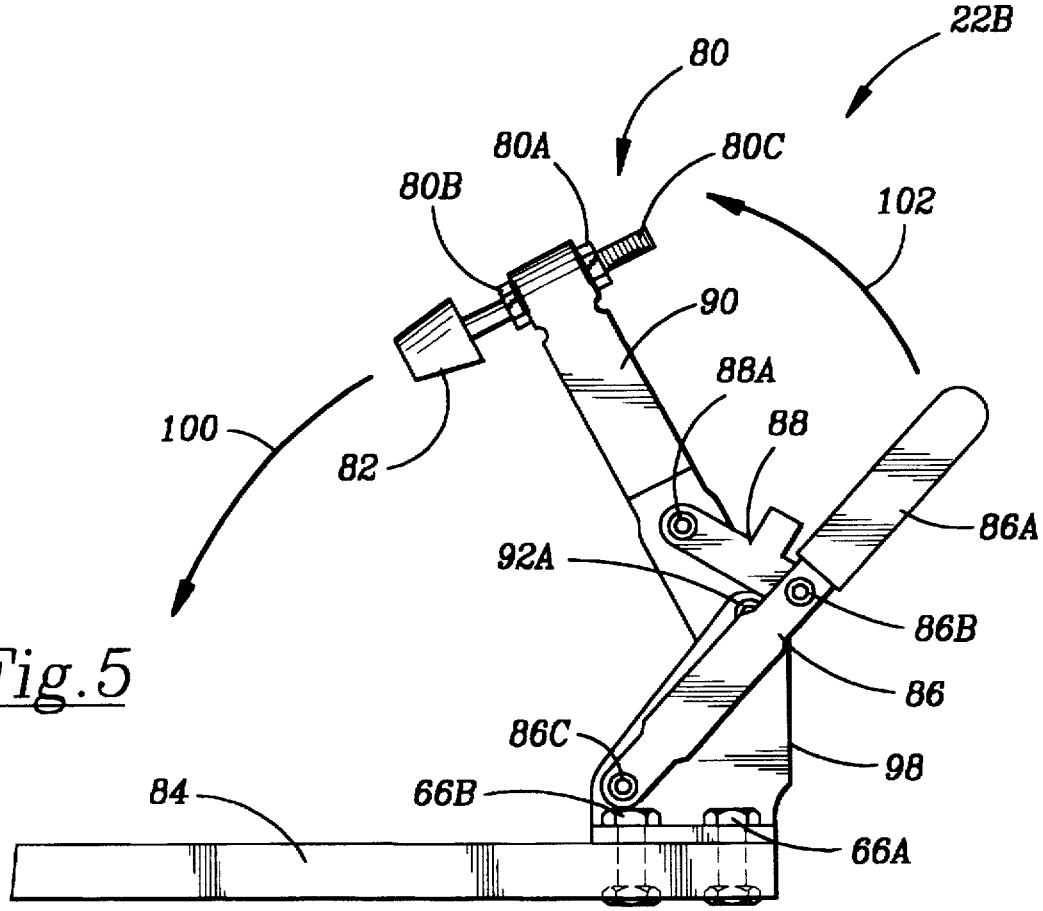
FIG. 5 is a side view of the other clamping means of the invention showing further details of the second clamping means.

As shown in FIG. 5, one of members comprising clamping means 22, member 22B comprises a frame 98 attached to base 84 by attaching means 66A and 66B. Lever arm 86 is attached to frame 98 by pivot joint 86C, and has an upper portion forming handle 86A. Clamp arm 90 is pivotally attached (not shown) to frame 98 and is adapted to accommodate adjustable vise means 80. Adjustable vise means 80 comprises an internally threaded nut, guide members 80A, 80B which are welded to the top and bottom of clamp arm 90, respectively, and threaded member 80C which is received by nut 80A. A resilient member 82 is positioned on the opposite end of threaded member 80C which is received by nut 80A. Resilient member 82 can be adjusted to provide for a tighter gripping force by turning threaded member 80C within nut 80A thereby extending or retracting resilient member 82.

Clamp arm 90 is coupled to lever arm 86 by central coupling arm 88. Central coupling arm 88 is pivotally attached to lever arm 86 below handle 86A (at pivot point 86B) and is also pivotally attached to clamp arm 90 (at pivot point 88A) so that as handle 86A is moved in the direction of arrow 102, clamp arm 90 moves in the direction of arrow 100. Central coupling arm 88 is attached at the lower end of clamp arm 90 so as to maximize mechanical advantage. However, coupling arm 88 must be attached intermediate arms 86 and 90 at the pivot points to insure that coupling arm 88 will not bind or lock up preventing clamp arm 90 and lever arm 86 from moving to accomplish the intended clamping action.

In operation, with FIG. 3, when a user decides to extract one or more sheets 40B from the stacked sheets 40 in the flat storage drawer 24, the portable arrangement 10 is positioned in drawer 24 as shown and described. The first clamping means 16 is then clampingly engaged to the lower plurality of sheets 40A by sliding base 78 under sheets 40A while lifting member 74, inserting the sheets 40A under lifting member 74, and permitting the member 74 to return to its rest portion clamping and retaining the sheets 40A against the base 78. The user may now earmark the upper plurality of sheets 40C, leaving the one or more sheets 40B to be retrieved resting upon the first clamping means 16.

The second clamping means 22 is adjusted so that resilient member 82 will clampingly engage end segment 96 of the plurality of sheets 40C. The plurality of sheets 40C is then arranged to provide an outwardly looped portion 94A and an inwardly looped portion 94B (as shown in FIG. 3). Once engaged, second clamping means 22 is positioned and rests on the top of looped upper sheets 40C and the combined weight of the sheets 40C and the second clamping means 22 keeps sheets 40C in the looped configuration.

The proper positioning of clamping means 22 atop sheet stack 40C is accomplished by sliding base 84 of second clamping means 22 under loop 94B and resting base 84 on top of loop 94A. Once base 84 is in this position, handle 86A is moved in direction 102 (FIG. 5) forcing resilient member 82 in the direction of base 84 thus clamping end segment 96 between resilient member 82 and base 84. Once in this position, threaded member 80B can be turned to increase the clamping force exerted on end segment 96 by resilient member 82 against base 84.

After the first and second clamping means 16 and 22 are attached to the lower plurality of sheets 40A and the upper plurality of sheets 40C, respectively, the one or more sheets 40B may now be easily removed from the flat storage drawer without being hindered by the weight of sheets 40C and without disturbing the sequence of the lower plurality of sheets 40A. The upper sheets 40C are lifted upward by tucking the sheet separator 14 under the plurality of sheets 40C as shown in FIG. 3 allowing for removal of sheet 40B. In addition, the plurality of sheets 40A and 40C remain aligned within drawer 24 awaiting the refiling of sheet 40B and without losing the place of sheet 40B in the sequential stack 40. The re-insertion of sheet 40B is accomplished without causing any tearing and without causing any creasing or misalignment of the sheet 40B or of any of the plurality of sheets 40A and 40C.

It should now be appreciated that the practice of the present invention provides for a variety of embodiments, all of which allow a single user to selectively extract at least one sheet from a plurality of stacked sheets in a file storage drawer without mutilating the sheet either upon extraction or refiling.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A portable apparatus for extracting at least one sheet from a plurality of sheets stacked in a flat storage drawer, having a pre-determined width and runners thereon, comprising:

a sheet separating means being mounted on at least one expandable transverse spanning member which in turn has at each end an angled sliding means for slidingly coupling to said runners and for assisting said sheet separating means in lifting at least one sheet located above said sheet to be extracted;

a first clamping means comprising a flat base with a tapered front end and at least one member having a surface for clamplingly engaging at least one sheet located below the sheet desired to be extracted; and a second clamping means comprising an elongated base and at least one member having a surface for clamplingly engaging at least one sheet located above the sheet desired to be extracted.

2. The portable apparatus according to claim 1, wherein said sheet separating means comprises at least two separating members having elevated front portions, said separating members being attached to said at least one transverse spanning member in an evenly spaced manner.

3. The portable apparatus according to claim 1, wherein each of said angled sliding means comprises a first angled, tubular member attached to a second angled, tubular member forming a channel for sliding along said runners.

4. The portable apparatus according to claim 1, wherein said at least one member of said first clamping means comprises a lever having a front lifting member, said lever being attached to said base and yieldingly biased by a spring member so that as said front lifting member is lifted said lever is raised.

5. The portable apparatus according to claim 1, wherein said at least one member having a surface for clamplingly engaging at least one sheet located above the sheet desired to be removed comprises:

an adjustable gripping means;

a frame attached to a first end of said elongated base;

a lever arm having a lower end pivotally attached to said frame and an upper end shaped to act as a handle;

a clamp arm having an upper end pivotally attached to said frame and a lower end which accommodates said adjustable gripping means; and a central coupling arm pivotally attached to said lever arm below said handle and pivotally attached at the lower end of said clamp arm so that as said handle is moved toward a second end of said elongated base said vise means contacts said second end of said elongated base.

6. The portable apparatus according to claim 1, wherein said expandable transverse spanning member further comprises a first transverse member and a second transverse member connected by a tubular member allowing said expandable transverse spanning member to expand to bridge different widths of said drawer.

7. A portable apparatus for use in a drawer for storing a plurality of flat sheets, said drawer having a predetermined width, sidewalls and runners said arrangement comprising:

a sheet separator comprising at least two separating members having elevated front portions and being attached to at least one expandable transverse spanning member, said transverse spanning member comprising a first transverse member and a second transverse member being joined by a tubular member allowing said expandable transverse spanning member to expand to bridge different widths of said drawer;

at least two slide members for coupling said at least one transverse spanning member to said runners, said slide members comprising a first angled tubular member connected to a second angled tubular member forming a channel there between;

at least one primary clamp for engaging at least one sheet below the sheet desired to be extracted said clamp comprising a lever attached to a base and yieldingly biased by a spring member;

at least one secondary clamp for engaging at least one sheet above the sheet desired to be extracted said clamp comprising a frame attached to an elongated base, a lever arm pivotally attached to said frame, a clamp arm having a lower end pivotally attached to said lever arm; and an adjustable vise member comprising a carrier bolt with threads at its upper end attached to said clamp arm in a threaded receiving member for adjusting said adjustable vise member and a lower end for receiving a flexible grip.

* * * * *